US005627433A

United States Patent [19]

Fulop et al.

[11] Patent Number: 5,627,433

[45] Date of Patent: May 6, 1997

[54] SINGLE-ENDED DISCHARGE LAMP HAVING AN IMPROVED ELECTRICAL CONNECTION ARRANGEMENT

[75] Inventors: Jozsef Fulop, Budapest, Hungary; Clarence J. Harsa, Broadview Heights, Ohio; Ferenc Papp; Jozsef Tokes, both of Budapest, Hungary

[73] Assignee: General Electric Company, Schenectady, N.Y.

[21] Appl. No.: 376,498

[22] Filed: Jan. 23, 1995

[30] Foreign Application Priority Data

Jan. 25, 1994 [HU] Hungary ..... P9400205

[51] Int. Cl.[6] ..... H01J 5/50; H01J 61/56

[52] U.S. Cl. ..... 315/56; 315/58; 313/318.04; 439/611; 439/617

[58] Field of Search ..... 439/611, 617, 439/699, 78, 83, 79; 315/56, 58, 61, 72; 313/318.02, 318.03, 318.04, 318.05, 318.06

[56] References Cited

U.S. PATENT DOCUMENTS 5,289,079 2/1994 Wittmann ..... 313/318
5,341,068 8/1994 Nerone ..... 315/219

FOREIGN PATENT DOCUMENTS 3439137 5/1986 Germany .

*Primary Examiner*—Robert Pascal
*Assistant Examiner*—Arnold Kinkead
*Attorney, Agent, or Firm*—George E. Hawranko

[57] ABSTRACT

This invention relates to a single-ended discharge lamp having an electric circuitry placed in its base member, which discharge lamp comprises a discharge tube filled with additive and gas, is sealed in a gas-tight manner and is provided with electrodes. A base member is provided for the mounting of the discharge tube and for incorporating the electric circuitry mounted on a printed circuit board therein. The base member has a screw base mounted thereon both for mechanical and electrical connection to a socket. Furthermore, the terminals of the circuitry are fixed and are electrically connected with the electrode lead wires by means of mechanical connector arrangement where the mechanical connector component is one contiguous metal part. The essential feature of the solution according to the invention is the mechanical connector arrangement includes a base part and a connection part of which the base part is embedded in the printed circuit board and the electrode lead wires are connected to the connection part. The connection part is formed as a cavity and the electrode lead wires intrude into this cavity and the electrode lead wires are mechanically fixed and simultaneously electrically connected to the wall of the cavity.

6 Claims, 3 Drawing Sheets

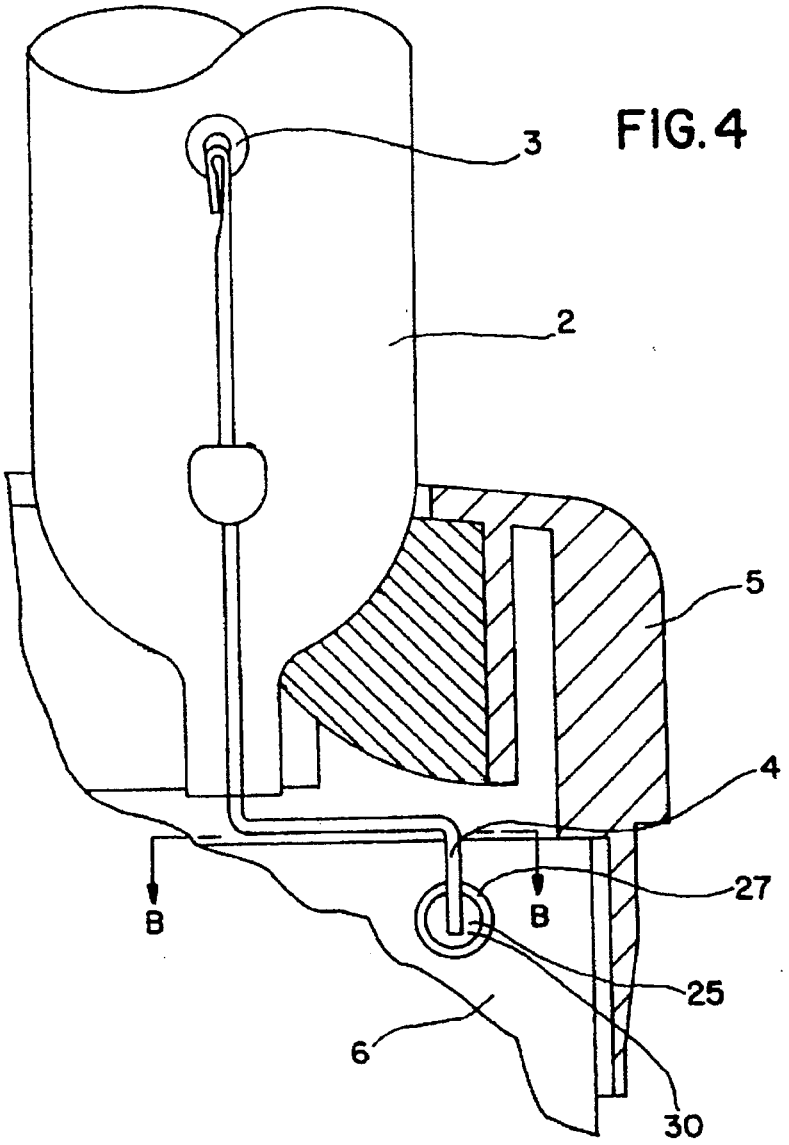
FIG. 4
B-B
FIG. 5
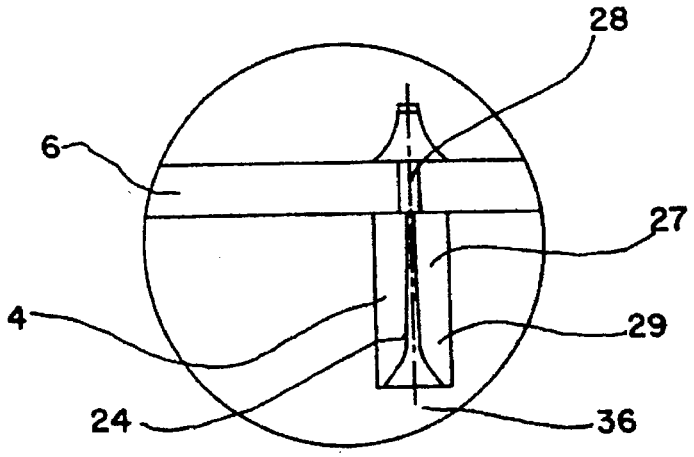

SINGLE-ENDED DISCHARGE LAMP HAVING AN IMPROVED ELECTRICAL CONNECTION ARRANGEMENT

FIELD OF THE INVENTION

This invention relates to a single-ended discharge lamp having ballast circuitry disposed in its base member, which discharge lamp comprises a discharge tube containing a fill. The discharge tube is sealed in a gas-tight manner and is provided with electrodes. More particularly, this invention relates to such a discharge lamp as utilizes a unique solderless mechanical and electrical connection arrangement for the lamp lead wires that facilitates high speed automated manufacture of such lamps.

BACKGROUND OF THE INVENTION

With the compact-design discharge lamps such as the widely used compact fluorescent lamps, several solutions are known for connecting the electrode inleads of the discharge tube with the output terminals of the corresponding operating circuitry typically disposed in the base housing.

When choosing a specific solution for performing the electrical connection, it is a fundamental consideration that it is preferable to avoid using soldered or welded joints since in case of a printed circuit board with a high density of components, it is difficult to access such components and the assembly operation would be troublesome to be automated. In addition, the process of soldering or welding would exert a heat load that adversely affects the electronic circuitry. Further, in certain applications, solder materials of higher melting points would also be needed which, in addition to the fact that this would cause a heat load of intolerable extent, it would necessitate the use of some special flux material that could release vapors detrimental to health. Moreover, the flux material that has spilled would have to be removed later—an activity making the manufacturing process troublesome.

Those problems explained in the above make it obvious that a mechanical connection is the only solution deserving consideration.

Such a mechanical connection, i.e., a discharge lamp having mechanical connector components is described, e.g., in German Patent Specification No. DE 34 39 137. In this solution a contact pin is fixed in a contact holder part embedded in the electronic circuitry printed circuit board of a compact fluorescent lamp. In order to make electrical contact, the other end of such contact pin is pressed together with the electrode inlead of the discharge tube, into an accepting portion formed in the plastic base member of the compact fluorescent lamp. The electrode inlead and the contact pin are clamped one to another by the resilient force of the plastic side wall of the hole. It is known that plastic materials that can be used in mass products have poorer elastic properties than metals, and the elasticity of plastic materials even decreases as time elapses. This means that the solution according to the patent mentioned is unable to provide a sufficiently reliable contact between the electrode inleads and the output terminals of the electronic circuitry over the life of the product.

When choosing the type of solution for the mechanical joint, the material of the electrode inlead of the discharge tube should be considered, both in respect of its mechanical properties and its suitability for making electrical contact.

The solution according to the invention can be applied with advantage, e.g., in case of all types of the so-called compact-design discharge lamps having the electronic ballast in the base member, particularly in those having a printed circuit board carrying the electronic circuitry assembled in a crowded and hard-to-access way.

SUMMARY OF THE INVENTION

The objective of our invention was to provide a solution, by means of which the disadvantage mentioned can be eliminated and, at the same time can also be used in discharge lamps having electrode inleads made from materials—i.e., not only copper but e.g., nickel-plated iron-nickel alloy—with which it is difficult to make electrical contact, and which solution enables the automation of assembling.

Based on those we have recognized, the objective set can be achieved by developing a discharge lamp that comprises appropriately chosen mechanical connector components, the base part of which mechanical connector component is embedded into the printed circuit board of the circuitry and is connected with the output terminals of the circuitry, and its connection part is hollow, into which cavity the electrode inlead intrudes to be connected mechanically as well as electrically to the wall of the cavity.

In accordance with the provisions of the present invention, there is provided a single-ended discharge lamp having an electric circuitry placed in its base member, which discharge lamp comprises a discharge tube filled with additive and gas, sealed in a gas-tight manner and provided with electrodes as well as a base member providing for the operation of the discharge tube and incorporating the electric circuitry mounted on a printed circuit board. A screw base member is provided in a way suitable both for mechanical and electrical connection to a conventional lamp socket. A base housing member is provided for mechanically fixing the discharge tube and for housing the ballast circuitry. Connector members are provided for connecting the output terminals of the circuitry with the electrode inleads of the discharge tube. Additionally, the terminals of the electronic ballast circuitry are fixed on the printed circuit board and are electrically connected with the electrode inleads of the discharge tube by means of the mechanical connector arrangement. The mechanical connector arrangement is one contiguous metal part and consists of a base part and a connection part, of which the base part is embedded in the printed circuit board and the electrode inlead is connected with the connection part. In addition, the base part is fixed on the printed circuit board and is electrically connected with the corresponding output terminal of the circuitry, and the connection part is formed to have a cavity, into which cavity the electrode inlead intrudes and the electrode inlead is mechanically fixed and simultaneously electrically connected to the wall of the cavity.

In a preferred embodiment of the discharge lamp according to the invention, the electrode inlead and the connector part are formed to make a deformation joint, i.e., to have a shape that mechanically fixes the electrode inlead to the wall of the cavity. In this case the connection part of the mechanical connector arrangement preferably has a cylindrical shape and its cavity is a blind hole, in which the electrode inlead is placed in the direction of the axis of the mechanical connector component. The electrode inlead is mechanically secured within the blind hole by means of an indentation made in a direction perpendicular to the axis, which indentation causes a permanent deformation on the wall of the blind hole and on the electrode inlead resulting in a permanent joint.

In another preferred embodiment of the discharge lamp according to the invention, the connection part of the mechanical connector arrangement is resilient and the electrode inlead is fixed to it by means of its resilient force. Joints of this type are releasable by exerting sufficient force against the resilient force. In this case the mechanical connector arrangement can be made, e.g., in the way that its connection part is formed by resilient pieces of plate and the electrode inlead is placed—perpendicularly to the axis of the mechanical connector component—in a slot-like cavity formed by the base plate and a tongue part cut and bent out from the middle portion of the base plate. Furthermore, an accepting portion is formed in at least one of the resilient pieces of plate, and the electrode inlead is formed to snap into this accepting portion to be secured in it.

The mechanical connector arrangement can also be formed in the way, e.g., that its connection part is represented by a tube with a slot along its generatrix, which tube is resilient perpendicularly to the slot where the cavity of the connection part is formed by the hollow of the tube and by the slot, and the electrode inlead is placed in the slot in a direction perpendicular to the axis of the mechanical connector member. Such a solution is especially advantageous in the case of electrode inleads with which it is difficult to make electrical contact since during manufacturing, on introducing the electrode inlead into the slot, the surface of the electrode inlead will be scratched resulting in better electrical contact.

With all embodiments of the discharge lamp, in order to make manufacturing easier it is practical to shape the mechanical connector arrangement in the way that the connection part broadens at the place where the electrode inlead is inserted.

BRIEF DESCRIPTION OF THE DRAWINGS

Hereinafter our invention will be illustrated in more details by means of examples as shown in the attached drawings in which:

FIG. 4 is an elevational view in section of a third embodiment of the discharge lamp according to the invention.

FIG. 5 is an elevational view taken along line B—B of the detail according to FIG. 4.

DETAILED DESCRIPTION OF THE INVENTION

Figure 1:
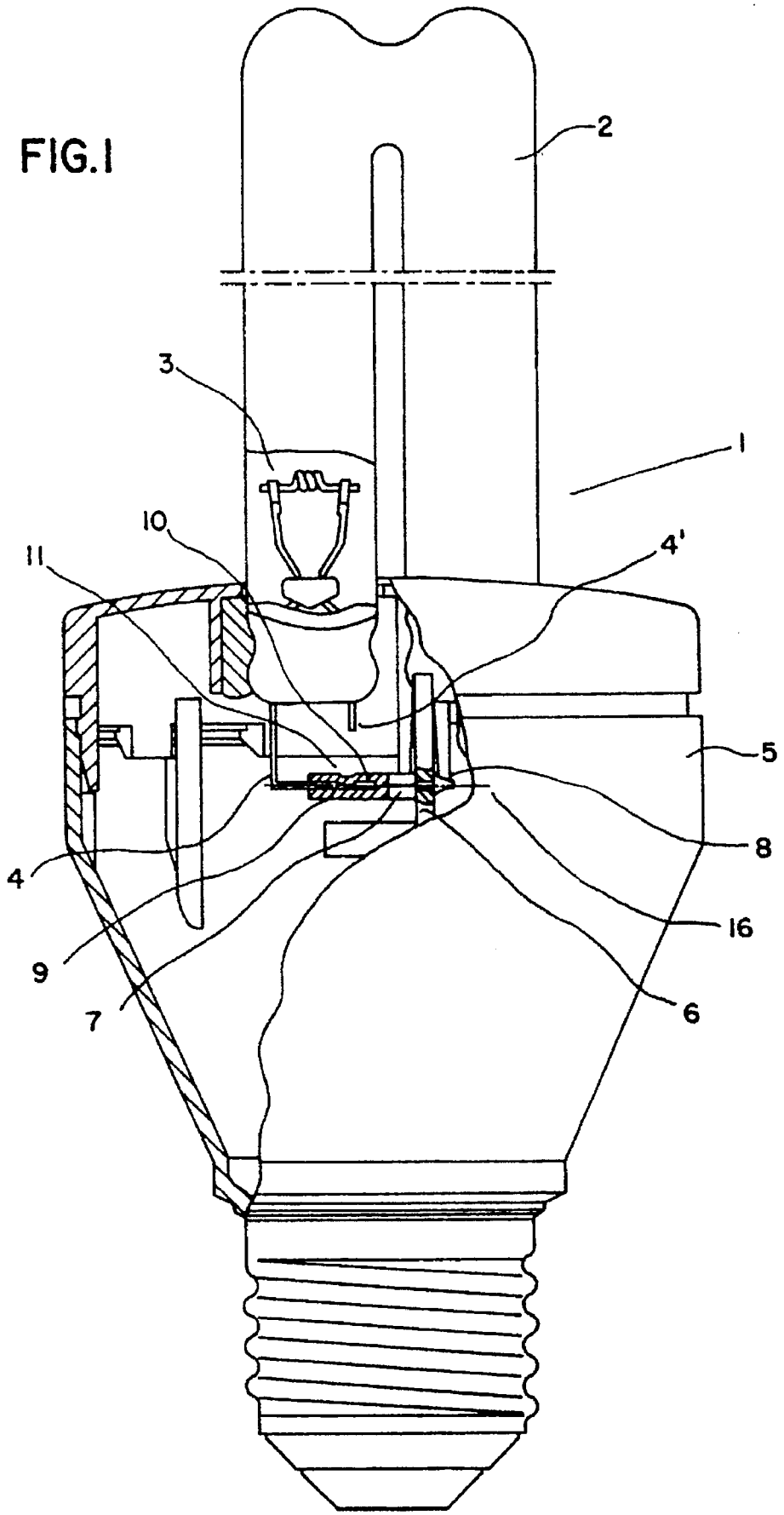
FIG. 1 is an elevational view in section of one embodiment of the discharge lamp according to the invention.

In case of the discharge lamp 1 shown in FIG. 1 being a compact fluorescent lamp in our example, the discharge tube 2 is mechanically supported by the upper portion of the base member 5 that has a threaded end portion and is suitable for connection to a conventional lamp socket for receiving line power. The electrode inlead 4 of one of the electrodes 3 of the discharge tube 2 is inserted into the cavity 10 of the cylindrical connection part 9 of the mechanical connector arrangement 7 embedded in the printed circuit board 6 fixed vertically in the base member 5, and is fixed in the cavity 10 by means of the deformation joint 11. The cavity 10 is a blind hole. The mechanical connector arrangement 7, which can be made, e.g., from copper, is embedded—preferably by means of close fit—into the hole of the printed circuit board 6 caught by its base part 8, and somewhat protrudes from the printed circuit board 6 at the other end of the hole where it is soldered and thereby electrically connected with the corresponding output terminal of the circuitry placed on the printed circuit board 6. For a description of the circuit arrangement which is disposed on the printed circuit board 6, reference is hereby made to U.S. Pat. No. 5,341,068 issued to Nerone on Aug. 23, 1994, which is herein incorporated by reference. The deformation joint 11 can be formed, e.g., by making an indentation in a direction perpendicular to the axis 16 of the mechanical connector arrangement 7 resulting in a permanent deformation of the mechanical connector arrangement 7. For connecting the electrode inleads 4' (and all further inleads that are shown in the FIG.), another mechanical connector arrangement also embedded in the printed circuit board 6 is used.

Figure 2:
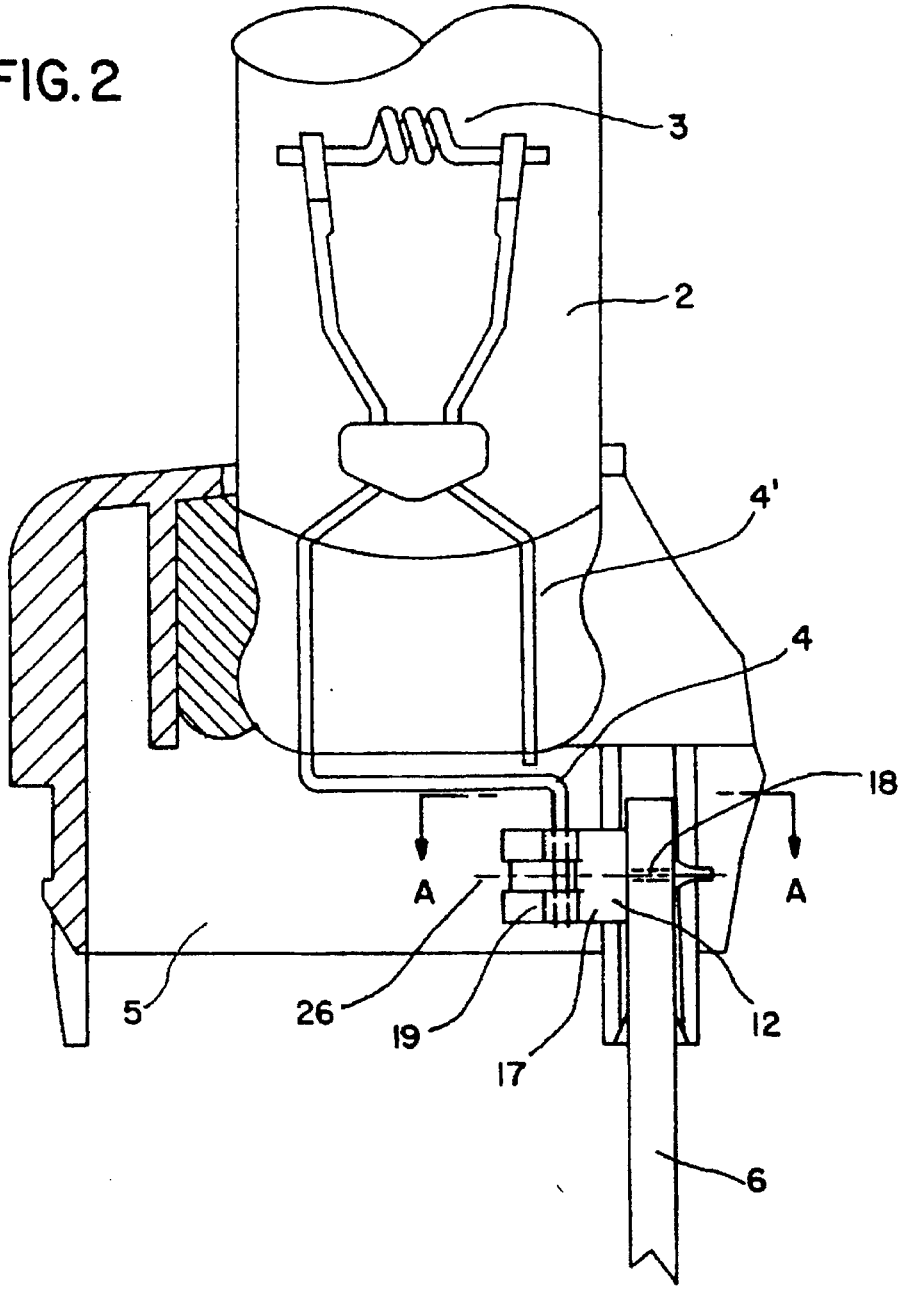
FIG. 2 is an elevational view in section of another embodiment of the discharge lamp according to the invention.
Figure 3:
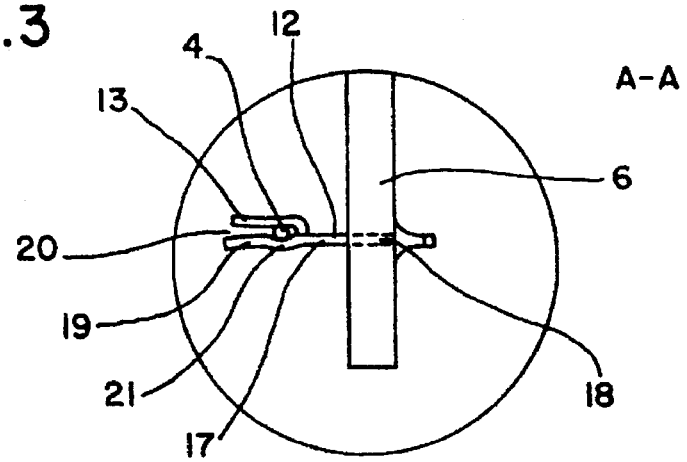
FIG. 3 is an elevational view taken along line A—A of the detail according to FIG. 2.

In case of the embodiment of the discharge lamp, details of which are shown in FIGS. 2 and 3, the electrode inlead 4 of one of the electrodes 3 of the discharge tube 2 is place in a slot-like cavity 20 formed at the resilient connection part 19 of the mechanical connector arrangement 17. The connection part 19 of the mechanical connector arrangement 17 that can be made, e.g., from beryllium bronze, is formed by resilient pieces of plate in the way that the electrode inlead 4 is inserted—in a direction perpendicular to the axis 26 of the mechanical connector 17—into the slot-like cavity 20 formed by the tongue portion 13 cut and bent out from the middle portion of the base plate 12 and by the base plate 12. In at least one of the resilient pieces of plate, e.g., in the base plate 12, an accepting portion 21 is formed. The electrode inlead 4 is forced to snap into the accepting portion 21 and thus remains in a fixed position. The mechanical connector 17 is embedded and soldered at its base part 18, in the printed circuit board 6 placed in the base member 5.

In case of the discharge lamp, details of which are shown in FIGS. 4 and 5, the electrode inlead 4 of the electrode 3 of the discharge tube 2 is placed in the cavity 30 of the connection part 29 of the mechanical connector 27 that can be made, e.g., from beryllium bronze. The connection part 29 is represented by a tube having a slot 24 along its generatrix and being resilient in a direction perpendicular to the slot 24 where the cavity 30 of the connection part 29 is formed by the hollow portion 25 of the tube and by the slot 24. The electrode inlead 4 is placed in the slot 24 in a direction perpendicular to the axis 36 of the mechanical connector 27, and in order to ensure that connection is secure, the electrode inlead 4 preferably intrudes also in the hollow portion 25 of the tube. The electrode inlead 4 is kept in the slot 24 by the resilient tube wall, by clamping the inlead 4 from two opposite sides. The mechanical connector 27 is, caught by its base part 28, embedded and soldered in the printed circuit board 6 placed in the base member 5.

In the examples of our embodiments, the electrode inleads can be made, e.g., from copper, but also from a material—such as nickel-plated iron-nickel alloy—with which it is more difficult to make electrical contact.

The connection part of the mechanical connector arrangement is preferably broadened at the places where the electrode inleads are inserted.

The scope of protection for our invention allows the discharge lamp according to our invention to be made in several different embodiments and, in accordance with this our invention is not intended to be limited to the examples shown beforehand.

What is claimed is:

1. A low pressure discharge lamp comprising:

a lamp envelope having an internal coating and fill contained therein;

electrodes disposed within said lamp envelope;

lead wires extending from said electrodes and through a sealed region of said lamp envelope;

said lamp envelope being mounted on a base housing member, said base housing member further having a screw base mounted thereon, said screw base being receptive of line power;

a ballast circuit arrangement disposed within said base housing member, said ballast circuit arrangement being receptive of such line power and effective so as to develop therefrom, an operating signal for driving said discharge lamp;

at least two connector members mounted on a circuit board portion of said ballast circuit arrangement, each of said at least two connector members simultaneously mechanically and electrically connecting a corresponding one of said lead wires to said ballast circuit arrangement without a need of a solder joint;

wherein said lead wires are mechanically secured to an interior wall portion of a cavity formed in each of said at least two connector members by means of a deformation joint; and, wherein said at least two connector members are cylindrical in shape and the cavity formed therein is a blind hole in which the lead wires are placed in the direction of the axis of said at least two connector members, and the electrode inlead is mechanically fixed in the blind hole by means of an indentation made in a direction perpendicular to the axis.

2. A discharge lamp according to claim 1 wherein said at least two connector members are embedded in said circuit board portion and are soldered thereto from a side of said circuit board portion opposite to the side in which said lead wires are connected to said connector members.

3. A discharge lamp according to claim 1 wherein said at least two connector members are resilient and the lead wires are mechanically fixed to said connector members by resilient force.

4. A discharge lamp according to claim 3 wherein said at least two connector members are formed by resilient pieces of plate in the way that said lead wires are inserted in a direction perpendicular to the axis said connector members, into a slot-like cavity formed by a tongue portion cut and bent out from a middle portion of a base plate, and in at least one of the resilient pieces, an accepting portion is formed, in which the lead wires are forced to snap thus remaining in a fixed position.

5. A discharge lamp according to claim 3 wherein said at least two connector members are represented by a tube having a slot along its generatrix and being resilient in a direction perpendicular to the slot where a cavity is formed by a hollow portion of the tube and by the slot and the lead wires are placed in the slot in a direction perpendicular to the axis of the connector members.

6. A discharge lamp according to claim 1 wherein said cavity is formed having a broadened opening as compared to an internal cross-sectional area of said cavity.

* * * * *